US010492522B2

(12) United States Patent
Flynn et al.

(10) Patent No.: US 10,492,522 B2
(45) Date of Patent: Dec. 3, 2019

(54) FLAVORED MENTHOL-CONTAINING OBJECTS FOR APPLICATION TO SMOKING ARTICLE COMPONENTS

(71) Applicant: R.J. Reynolds Tobacco Company, Winston-Salem, NC (US)

(72) Inventors: Steven D. Flynn, Winston-Salem, NC (US); Matthew E. Lampe, Winston-Salem, NC (US); Luis R. Monsalud, Kernersville, NC (US); Jeffrey A. Willis, Germantown, NC (US); Cynthia Stokes, Lexington, NC (US); Ronald Keith Hutchens, East Bend, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 92 days.

(21) Appl. No.: 15/585,665

(22) Filed: May 3, 2017

(65) Prior Publication Data

US 2018/0317540 A1 Nov. 8, 2018

(51) Int. Cl.
*A24B 15/18* (2006.01)
*A24D 3/04* (2006.01)
(Continued)

(52) U.S. Cl.
CPC ..... *A24B 15/186* (2013.01); *A24B 15/282* (2013.01); *A24B 15/283* (2013.01);
(Continued)

(58) Field of Classification Search
CPC ..... A24B 15/186; A24B 15/301
See application file for complete search history.

(56) References Cited

U.S. PATENT DOCUMENTS 1,625,771 A 4/1927 Schoellkopf
2,662,052 A 12/1953 Bridger et al.
(Continued)

FOREIGN PATENT DOCUMENTS

EP 0 223 454 5/1987
WO WO 2014/019804 2/2014
(Continued)

OTHER PUBLICATIONS

Borschke, A. J., "Review of Technologies Relating to Menthol Use in Cigarettes," *Recent Advances in Tobacco Science*, 1993, vol. 19, pp. 47-70.

*Primary Examiner* — Eric Yaary
(74) *Attorney, Agent, or Firm* — Womble Bond Dickinson (US) LLP

(57) ABSTRACT

The present invention relates to a method of making a flavored menthol-containing solid object, which can be used as an input material for hot melt application to a smoking article component. The method generally includes the steps of combining and heating menthol and a flavorant to give a molten mixture; depositing the molten mixture onto a surface; allowing the deposited molten mixture to cool to give a solidified mixture; and removing the solidified mixture from the surface to afford a flavored menthol-containing solid object. The method can further involve melting the solid object and applying the melted material to a smoking article component to modify the flavor/aroma profile of a smoking article into which the coated component is incorporated.

22 Claims, 1 Drawing Sheet

(51) Int. Cl.
*B05D 1/02* (2006.01)
*A24B 15/28* (2006.01)
*A24B 15/30* (2006.01)

(52) U.S. Cl.
CPC ..... *A24B 15/301* (2013.01); *A24D 3/048* (2013.01); *B05D 1/02* (2013.01)

(56) References Cited

U.S. PATENT DOCUMENTS

| | | | |
|---|---|---|---|
| 3,023,253 | A | 2/1962 | Bain et al. |
| 3,064,311 | A | 11/1962 | Bain et al. |
| 3,344,796 | A | 10/1967 | Goro et al. |
| 3,348,520 | A | 10/1967 | Lockwood |
| 3,972,335 | A | 8/1976 | Tiggelbeck et al. |
| 4,011,270 | A | 3/1977 | Carrington |
| 4,058,571 | A | 11/1977 | Biedermann |
| 4,281,671 | A | 8/1981 | Bynre et al. |
| 4,409,995 | A | 10/1983 | Nichols |
| 4,729,391 | A | 3/1988 | Woods et al. |
| 4,862,905 | A | 9/1989 | Green, Jr. et al. |
| 4,941,486 | A | 7/1990 | Dube et al. |
| 4,971,078 | A | 11/1990 | Deutsch et al. |
| 5,012,829 | A | 5/1991 | Thesing et al. |
| 5,019,658 | A | 5/1991 | Cahn |
| 5,147,034 | A | 9/1992 | Broadhead et al. |
| 5,269,329 | A | 12/1993 | Geer et al. |
| 5,387,285 | A | 2/1995 | Rivers |
| 5,396,909 | A | 3/1995 | Gentry et al. |
| 5,529,789 | A | 6/1996 | Lo |
| 5,626,896 | A | 5/1997 | Moore et al. |
| 5,663,460 | A | 9/1997 | Yamamoto et al. |
| 5,724,997 | A | 3/1998 | Smith et al. |
| 5,752,529 | A | 5/1998 | Mane et al. |
| 6,342,644 | B1 | 1/2002 | Sayo et al. |
| 7,381,277 | B2 | 6/2008 | Gonterman et al. |
| 7,459,587 | B2 | 12/2008 | Nakayasu et al. |
| 7,709,688 | B2 | 5/2010 | Bergner et al. |
| 7,770,585 | B2 | 8/2010 | Fowles |
| 7,810,508 | B2 | 10/2010 | Wyss-Peters et al. |
| 8,288,593 | B2 | 10/2012 | Rauls et al. |
| 8,318,985 | B2 | 11/2012 | Heydrich et al. |
| 8,785,698 | B2 | 7/2014 | Nagaoka et al. |
| 9,061,959 | B2 | 6/2015 | Maeda et al. |
| 9,078,460 | B2 | 7/2015 | Emanuel |
| 9,119,420 | B2 | 9/2015 | Sebastian |
| 9,554,594 | B2 | 1/2017 | Clark et al. |
| 2002/0020420 | A1 | 2/2002 | Xue et al. |
| 2002/0166563 | A1 | 11/2002 | Jupe et al. |
| 2004/0224086 | A1 | 11/2004 | Wright |
| 2009/0011238 | A1 | 1/2009 | Rheinlander et al. |
| 2009/0235941 | A1 | 9/2009 | Chida et al. |
| 2010/0185024 | A1 | 7/2010 | Rauls et al. |
| 2013/0167851 | A1 | 7/2013 | Ademe et al. |
| 2014/0066665 | A1 | 3/2014 | Mechelhoff et al. |
| 2014/0360518 | A1 | 12/2014 | Besso |
| 2015/0004291 | A1 | 1/2015 | Alzemi |

FOREIGN PATENT DOCUMENTS

| | | |
|---|---|---|
| WO | 2016/016154 | 2/2016 |
| WO | 2016/034481 | 3/2016 |

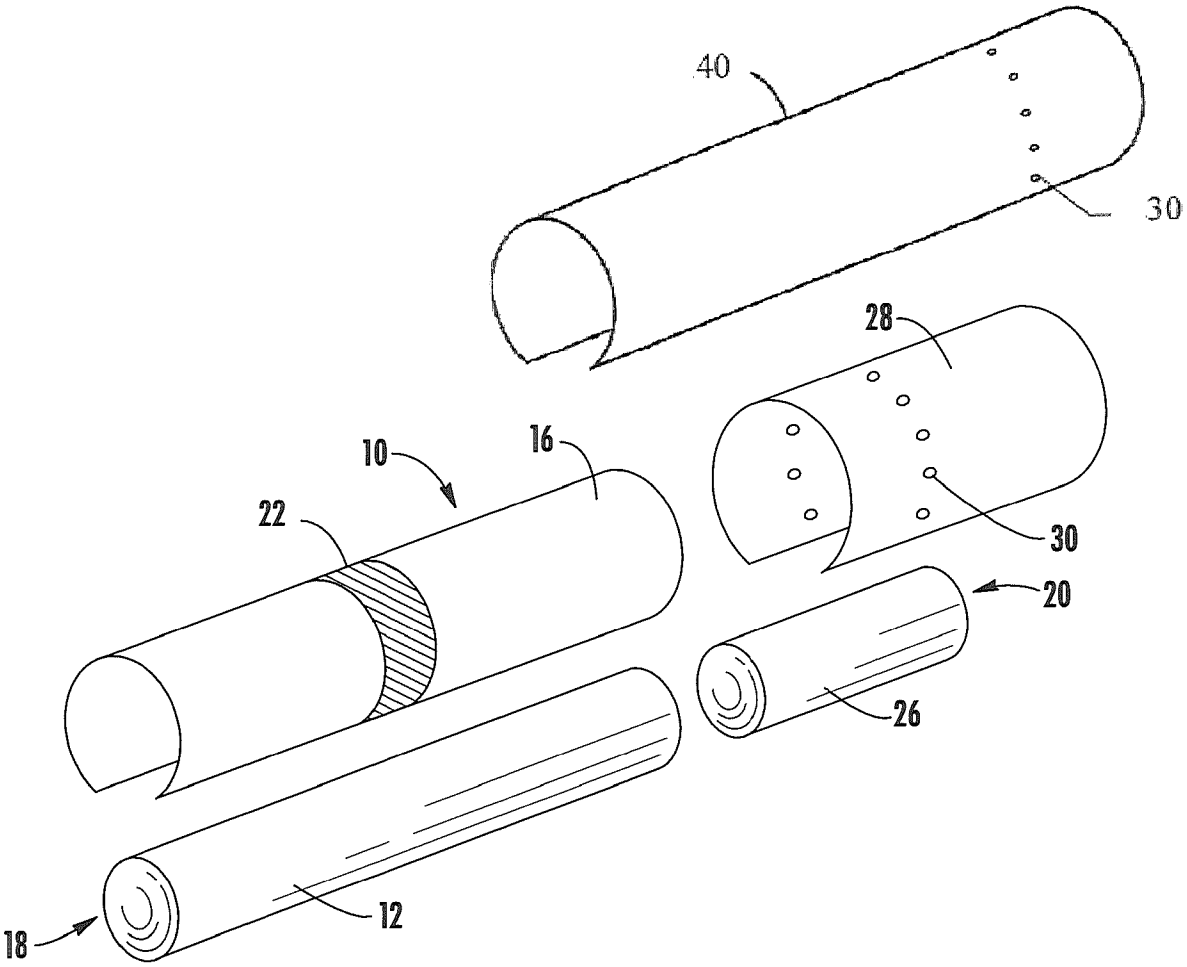
30
40
28
30
20
26
16
10
22
12
18

FLAVORED MENTHOL-CONTAINING OBJECTS FOR APPLICATION TO SMOKING ARTICLE COMPONENTS

FIELD OF THE INVENTION

The present invention relates to a method of making a solid flavored menthol-containing object, which can be used in the preparation of a coated component of a smoking article.

BACKGROUND OF THE INVENTION

Cigarettes, cigars, and pipes are popular smoking articles that employ tobacco in various forms. Such smoking articles are employed by heating or burning tobacco to generate aerosol (e.g., smoke) that may be inhaled by the smoker. Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. A cigarette is employed by a smoker by lighting one end thereof and burning the tobacco rod. The smoker then receives mainstream smoke into his/her mouth by drawing on the opposite end (e.g., the filter end) of the cigarette.

The sensory attributes of cigarette smoke can be enhanced by applying additives to tobacco and/or by otherwise incorporating flavoring materials into various components of a cigarette. See, Leffingwell et al., *Tobacco Flavoring for Smoking Products*, R.J. Reynolds Tobacco Company (1972). The primary function of such additives/flavoring components is to enhance the tobacco flavors produced upon heating or combusting the tobacco material within the smoking article, or to provide additional non-tobacco flavors such as mint and/or menthol. Menthol, in particular, is a common flavorant for use, e.g., in cigarettes and pipe tobacco. It is used mainly because of the refreshing/cooling effects it can impart to tobacco smoke. Menthol is a flavorant with a high degree of volatility at room temperature, which can make control of menthol concentration in smoking articles difficult. Other flavorants have also been used. See, for example, U.S. Pat. No. 3,006,347 to Keaton et al.; U.S. Pat. No. 3,236,244 to Harlow et al.; U.S. Pat. No. 3,344,796 to Yamaji et al.; U.S. Pat. No. 3,426,011 to Parmerter et al.; U.S. Pat. No. 3,972,335 to Tiggelbeck et al.; U.S. Pat. No. 4,715,390 to Nichols et al.; U.S. Pat. No. 5,137,034 to Perfetti et al.; U.S. Pat. No. 5,144,964 to Dermain et al.; U.S. Pat. No. 5,479,949 to Battard et al.; U.S. Pat. No. 5,584,306 to Beauman et al.; U.S. Pat. No. 5,724,998 to Gellatly et al.; U.S. Pat. No. 6,516,809 to Schumacher et al.; and U.S. Pat. No. 6,325,859 to de Roos et al.

For example, one type of tobacco flavoring additive is menthol. See, Borschke, *Rec. Adv. Tob. Sci.*, 19, p. 47-70, 1993. Various proposed methods for modifying the sensory attributes of cigarettes have involved suggestion that filter elements may be used as vehicles for adding flavor to the mainstream smoke of those cigarettes. US Pat. Appl. Pub. No. 2002/0166563 to Jupe et al. proposes the placement of adsorbent and flavor-releasing materials in a cigarette filter. US Pat. Appl. Pub. No. 2002/0020420 to Xue et al. proposes the placement of fibers containing small particle size adsorbents/absorbents in the filter. U.S. Pat. No. 4,941,486 to Dube et al. and U.S. Pat. No. 4,862,905 to Green, Jr. et al. propose the placement of a flavor-containing pellet in a cigarette filter. Other representative types of cigarette filters incorporating flavoring agents are set forth in U.S. Pat. No. 3,972,335 to Tiggelbeck et al.; U.S. Pat. No. 4,082,098 to Owens, Jr.; U.S. Pat. No. 4,281,671 to Byrne; U.S. Pat. No. 4,729,391 to Woods et al.; and U.S. Pat. No. 5,012,829 to Thesing et al.

There are many different routes for the addition of flavorants to smoking articles. For example, liquid flavorant compositions can be sprayed directly onto tobacco or can be applied to various components of the smoking articles (e.g., wrapping material, the tobacco rod, and/or the filter plug). As another example, such flavorants can be applied in melted form, in combination with one or more additional components. See, for example U.S. Pat. No. 4,082,098 to Owens et al.; U.S. Pat. No. 4,409,995 to Nichols et al.; U.S. Pat. No. 4,971,078 to Deutsch et al.; U.S. Pat. No. 5,396,909 to Gentry et al.; U.S. Pat. No. 5,752,529 to Mane et al.; U.S. Pat. No. 5,724,997 to Smith et al.; U.S. Pat. No. 7,381,277 to Gonterman et al.; U.S. Pat. No. 7,810,508 to Wyss-Peters et al.; U.S. Pat. No. 9,554,594 to Clark et al.; U.S. Pat. Appl. Pub. No. 2013/0167851 to Adenne et al.; and Int. Pat. Appl. Pub. No. WO2014/019804 to Ferarazzin et al. Known methods for the addition of flavorants have several shortcomings. For example, where liquid flavorant compositions are used, flavorant can evaporate during the preparation of the liquid flavorant composition, resulting in fluctuations in concentration of each flavorant therein. Similarly, where flavorant is added to a melted composition to be applied to the smoking article component, it is difficult to control the exact concentration of that flavorant due, e.g., to evaporation of the flavorant during addition. Such methods also typically employ diluents and/or carriers, which limit the amount of flavorant that is actually applied onto the smoking article component. It would be beneficial to provide alternate means and/or processes for applying flavor-containing compositions to smoking articles.

SUMMARY OF THE INVENTION

The present disclosure provides a method of making flavored menthol-containing solid objects and to the objects themselves. The disclosure also provides a method of coating components of smoking articles using such flavored menthol-containing solid objects. The flavored menthol-containing solid object can specifically be used as an input material for a hot melt application apparatus to coat smoking article components. Smoking article components that can be coated with the menthol-containing melt prepared in this manner include components that are exposed to an increase in temperature during use, such that at least a portion of the coated components (e.g., menthol and flavorants) vaporize during use.

One aspect of the invention is directed to a method of making a flavored menthol-containing solid object for use as an input material for hot melt application to a smoking article component, comprising: combining and heating menthol and a flavorant to give a molten mixture; depositing the molten mixture onto a surface; allowing the deposited molten mixture to cool to give a solidified mixture; and removing the solidified mixture from the surface to afford a flavored menthol-containing solid object. In some embodiments, the method further comprises chilling the surface. In some embodiments, the menthol comprises L-menthol. In some embodiments, the method further comprises purifying the menthol prior to the combining step. In some embodiments, the purifying comprises recrystallizing. In some embodiments, the flavorant is a flavor oil selected from one or more of mint, fruit, clove, and vanilla oils. In some embodiments, the removing step comprises affording the flavored menthol-containing solid object in the form of a flake. In some embodiments, the surface comprises molded three-dimensional shapes. In some embodiments, the three-dimensional shapes are selected from a cube, cuboid, sphere, spheroid, cylinder, cone, prism, pyramid, frustum, and combinations thereof. In some embodiments, the three-dimensional shapes are spheres. In some embodiments, the flavored menthol-containing solid object has an average diameter of about 0.1 to about 6 mm. In some embodiments, the flavored menthol-containing solid object comprises at least about 90% menthol by weight. In some embodiments, the flavored menthol-containing solid object comprises at least about 95% menthol by weight. In some embodiments, the flavored menthol-containing solid object comprises no more than 5% flavorant by weight. In some embodiments, the weight of the flavored menthol-containing solid object is about 0.75 g to about 2.5 g.

In some embodiments, the method further comprises: melting the flavored menthol-containing solid object to afford a molten coating material; applying the molten coating material to a smoking article component; and allowing the applied molten coating material to solidify, to afford a flavored menthol-coated smoking article component. In some embodiments, the method further comprises repeating the applying and allowing steps to provide a flavored menthol-coated smoking article component with more than one coating thereon. In some embodiments, the method further comprises agitating or stirring during the melting step. In some embodiments, the molten coating material is substantially free of diluents and carrier materials. In some embodiments, the melting step comprises melting a plurality of flavored menthol-containing solid objects. In some embodiments, the smoking article component is selected from a cylindrical tobacco rod, a filter rod, wrapping material, and plug wrap material. In some embodiments, the applying step comprises spraying the molten coating material onto the smoking article component. In some embodiments, the method further comprises incorporating the flavored menthol-coated smoking article component into a smoking article.

One aspect of the invention is directed to a flavored menthol-containing solid object prepared according to the methods disclosed herein. In some embodiments, the weight of the object is about 0.75 g to about 2.5 g.

The disclosed two-step process (wherein menthol and one or more flavorants are first combined and formed into a flavored menthol-containing solid object and then this object is used in the coating process) provides various advantages over the conventional one-step process of coating such components (wherein menthol is combined with one or more flavorants during the coating process).

For example, the disclosed method can advantageously provide for lower loss of flavorant during the preparation of molten material in hot melt application methods for coating the smoking article component. Conventional hot melt application methods combine and melt all ingredients to be contained within the desired coating independently, and this molten mixture is used in the coating process. During the combining and melting, volatile components (e.g., flavorants) can evaporate due to the heating, providing less control over the exact concentration of each component in the formed melt to be applied. By contrast, the disclosed method provides a pre-formed flavored menthol-containing solid object as the input material for the hot melt application apparatus. As this input material already contains the desired amount of menthol and flavorant, it can be directly heated (melted) and directly applied via hot melt application methods to the smoking article component(s). Advantageously, the amount of flavorant is largely controlled, as evaporation is decreased (e.g., minimal) during the melting process, as no combining and mixing steps are required to provide the molten material to be coated onto the smoking article component(s).

In certain preferred embodiments of the disclosed method, the molten material (prepared from the referenced flavored menthol-containing solid object) is applied neat to the smoking article component (i.e., no carrier material or diluent is included within the material), allowing for a significant amount of molten material to be applied in a single coat to the component. Carrier materials and diluents, which are commonly added to melts in conventional application methods to improve the physical properties of the melt, e.g. viscosity and/or to ensure adequate mixing of components, leads to dilution of the melt components and, as such, reduces the amount of the desired components (e.g., menthol and/or other flavorants) that can be applied onto the smoking article component.

BRIEF DESCRIPTION OF THE DRAWING

In order to assist the understanding of embodiments of the invention, reference will now be made to the appended drawing, which is not necessarily drawn to scale. The drawing is exemplary only, and should not be construed as limiting the invention.

FIG. 1 is an exploded perspective view of a smoking article having the form of a filtered cigarette.

DESCRIPTION OF THE INVENTION

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. Like components are given like numeric designations throughout the figures. As used in this specification and the claims, the singular forms "a," "an," and "the" include plural referents unless the context clearly dictates otherwise.

The present invention provides a method of making solid objects containing menthol and a flavorant and to flavored menthol-containing solid objects produced by such method. The invention further provides a method of using such objects as an input material in a hot melt apparatus for hot melt application to a smoking article component to yield a smoking article component coated, at least partially, with a composition comprising menthol and a flavorant.

The method of making the flavored menthol-containing solid object generally comprises: (1) combining and heating menthol and a flavorant to give a molten mixture; (2)

depositing the molten mixture onto a surface; (3) allowing the deposited molten mixture to cool to give a solidified mixture; and (4) removing the solidified mixture from the surface to afford a flavored menthol-containing solid object. These solid objects can be made in any desired three-dimensional shape but, in preferred embodiments, are small enough to fit into the types of apparatus used for hot melt application of coatings (e.g., adhesives or menthol) to smoking article components. In such embodiments, the solid objects can be melted and applied to a suitable smoking article component.

Flavored Menthol-Containing Solid Object

In general, the presently disclosed flavored menthol-containing solid object comprises menthol and a flavorant and is in a solid form. Advantageously, the flavored menthol-containing solid object has a high menthol content. For example, in some embodiments, the amount of menthol within the object ranges from about 80% to about 99% or from about 85% to about 95% by weight (or at least 70%, at least 80%, at least 85%, at least 90%, at least 95%, at least 98%, or at least 99% by weight, based on an upper boundary of 100% by weight) based on the weight of the flavored menthol-containing solid object.

The menthol within the menthol-containing object is synthetic, natural or a combination thereof. The chemical purity of the menthol can vary. As used herein, "chemical purity" refers to the degree to which a substance is undiluted or unmixed with extraneous material, typically expressed as a percentage (%). In general, most materials contain a certain amount of impurities and, as such, have a chemical purity of less than 100%. Thus, the chemical purity of menthol is based on the amount of impurities present in addition to menthol, where a small amount of impurities present in the menthol indicates a high chemical purity. The impurities can result from the synthesis and/or purification of menthol and/or can be of natural origin. In some embodiments, the menthol is distilled prior to inclusion within the disclosed flavored menthol-containing solid object to increase the chemical purity. In some embodiments, the menthol is recrystallized prior to inclusion within the flavored menthol-containing solid object to increase the chemical purity thereof. In some embodiments, the menthol is synthetic with a chemical purity ranging from about 80% to about 100%, about 90% to about 100%, or about 95% to about 100% by weight (or at least 80%, at least 90%, at least 95%, or at least 99% by weight, with an upper boundary of 100% by weight). In some embodiments, the menthol is natural with a chemical purity ranging from about 60% to about 100%, about 70% to about 100%, about 80% to about 100%, or about 90% to about 100% by weight (or at least 60%, at least 70%, at least 80%, or at least 90% by weight, with an upper boundary of 100% by weight).

The menthol in the flavored menthol-containing solid object is selected from D-menthol, L-menthol, D-isomenthol, L-isomenthol, D-neomenthol, L-neomenthol, D-neosiomenthol, L-neoisomenthol and mixtures of any two or more of the foregoing. In some embodiments, the menthol is a mixture of L-menthol and D-menthol. In some embodiments, the menthol comprises at least about 50%, at least about 60%, at least about 70%, at least about 80%, at least about 90%, at least about 95%, at least about 96%, at least about 97%, at least about 98%, or at least about 99% by weight (with an upper boundary of 100% by weight) L-menthol. In some embodiments, the menthol comprises no more than about 50%, no more than about 40%, no more than about 30%, no more than about 20%, no more than about 10%, no more than about 5%, no more than about 4%, no more than about 3%, no more than about 2%, or no more than about 1% by weight D-menthol, with a lower boundary of 0%. In some embodiments, the menthol comprises L-menthol with no more than 1% by weight of D-menthol.

The flavorant present within the flavored menthol-containing solid object disclosed herein can be any material that can provide flavor and/or aroma in vapor form. In some embodiments, the flavorant is a flavor oil. Flavor oils are, for example, distilled or expressed from plants (e.g., leaves, stem, flowers, and/or fruit) or prepared synthetically. In some embodiments, the flavor oil is selected from one or more of mint oil, vanillin, ethyl vanillin, cream, tea, coffee, fruit-derived oil (e.g., apple, cherry, strawberry, peach and citrus flavors, including lime and lemon), maple, nutmeg, wintergreen, clove, lavender, cardamom, ginger, honey, anise, sage, cinnamon, sandalwood, jasmine, cascarilla, *eucalyptus*, cocoa, licorice, or combinations thereof. For additional examples of flavor oils, see Kirk-Othmer Encyclopedia of Chemical Technology, $4^{th}$ Edition and in The Merck Index, $13^{th}$ Edition, which is hereby incorporated in its entirety. In some embodiments, the flavor oil comprises a mint oil, (e.g., spearmint oil, peppermint oil, or a combination thereof). A flavor oil can be naturally or synthetically derived. In some embodiments, the chemical purity of the flavor oil (defined as above) ranges from about 80% to about 100%, from about 90% to about 100%, or from about 95% to about 100% by weight based on the weight of flavor oil.

The amount of flavorant in the flavored menthol-containing solid object can vary. It is readily recognized that flavorants with a strong flavor strength may require a smaller amount than flavorants having a weaker flavor strength to achieve a desired mainstream smoke flavor/aroma of smoking articles to which the material is applied, as is described in more detail below. In some embodiments, the amount of flavorant can be dependent upon physical properties and/or chemical characteristics of the flavorant, including but not limited to viscosity, density, and boiling point. For example, a higher concentration of a more volatile flavorant (i.e., a flavorant with a low boiling point) may be required than the concentration of a flavorant with a higher boiling point (which may vaporize at a slower rate at a given temperature) to produce the desired flavor/aroma profile of a smoking article to which the material is applied. In some embodiments, the amount of flavorant in the flavored menthol-containing solid object is about 1% to about 20%, about 2% to about 15% by weight, about 2% to about 10% by weight, or about 2% to about 8% by weight based on the weight of the flavored menthol-containing solid object.

In some embodiments, the flavored menthol-containing solid object consists essentially of menthol and one or more flavorants (e.g., flavor oils). In certain embodiments, the flavored menthol-containing solid object is a homogeneous mixture of menthol and flavorant. In certain embodiments, additional ingredients are included in the flavored menthol-containing solid object. Such ingredients include, but are not limited, to ingredients that can contribute beneficial flavor/aroma profiles when heated (e.g., in the context of a smoking article into which the ingredients are introduced). In some embodiments, such additional ingredients are ingredients contributing to other features of the menthol-containing solid object (e.g., physical characteristics such as shape, size, and stability). Preferably, such additional ingredients do not interfere with the use of the flavored menthol-containing solid object in hot melt applications. For example, in some embodiments, such ingredient preferably do not interfere with the melting of the flavored menthol-containing solid object and/or preferably do not significantly increase or decrease the viscosity of the molten material formed by melting the flavored menthol-containing solid object. In other embodiments, such ingredients do not significantly impact the vaporization of menthol and the flavorant when coated on a smoking article component (allowing for the production of a mainstream smoke containing menthol/flavorant vapor and having the desired flavor/aroma profile).

In some embodiments, the optional additional ingredient in the flavored menthol-containing solid object comprises an anti-caking agent. An anti-caking agent is a material that prevents the lumping and/or caking of a composition. Exemplary anti-caking agents include, but are not limited to, calcium phosphate, magnesium phosphate, magnesium hydroxycarbonate, magnesium oxide, mannitol, calcium silicate, magnesium silicate, talc, polydimethylsiloxane, silicon dioxide, salts of edible fatty acids (e.g., Al, Ca, Na, Mg, $NH_4^+$), and mixtures thereof. In some embodiments, the optional anti-caking agent comprises silicon dioxide. The amount of optional anti-caking agent in the flavored menthol-containing solid object can vary and may be, e.g., no more than about 8%, no more than about 5%, no more than about 2%, no more than about 1%, or no more than about 0.5% by weight, with a lower boundary of 0%, based on the weight of the flavored menthol-containing solid object.

Optional additional ingredients present in the flavored menthol-containing solid object can be incorporated within the individual flavored menthol-containing solid objects and/or can be located on the outside surface of flavored menthol-containing solid objects. For example, in some embodiments, an optional additional ingredient is mixed with the menthol and flavorant(s) to generate a homogenous mixture, with the optional additional ingredient incorporated throughout the mixture, and incorporated throughout the produced flavored menthol-containing solid object. In some embodiments, the optional additional ingredient(s) are incorporated in a non-homogenous manner. For example, in some embodiments, optional additional ingredients are concentrated in one or more select regions of the flavored menthol-containing solid object, resulting in a non-homogenous distribution throughout the object. For example, a flavored menthol-containing solid object can be segmented into an inner layer and an outer layer, wherein the inner layer contains a homogenous mixture of menthol and flavorants and the outer layer contains any additional ingredients (e.g., anti-caking agent). In some embodiments, the optional additional ingredient(s) are coated on the outside surface of the flavored menthol-containing solid object. In such embodiments, the amount of outside surface area covered can vary, e.g., ranging from about 70% to about 100%, from about 80% to about 98%, from about 85% to about 95% (or least about 70%, at least about 80%, at least about 90%, at least about 95%, at least about 98%, with an upper boundary of 100%) of surface area, based on the entire surface area of the flavored menthol-containing solid object.

The size and shape of the flavored menthol-containing solid objects can vary. Generally, the flavored menthol-containing solid object can comprise any three-dimensional shape. In some embodiments, the three-dimensional shape is a cube, cuboid, pyramid, cone, prism (e.g., a triangular or rectangular prism), cylinder, sphere, or spheroid (e.g., prolate or oblate spheroid).

The sizes of the flavored menthol-containing solid objects disclosed herein are, in part, dependent upon the shape and size which the hot melt apparatus in which they are intended to be used can accommodate. The size (e.g., dimensions such as length, width, height and/or diameter) of the flavored menthol-containing solid object is generally smaller than the size (e.g., dimensions such as length, width, height and/or diameter) of the portion of the hot melt apparatus to which the solid object is intended to be added. Typically, a plurality of the flavored menthol-containing solid objects is added to the hot melt apparatus and, as such, the solid objects are typically of a size such that a plurality of such objects can be contained within the portion of the hot melt apparatus to which the objects are to be added. In such embodiments, the plurality of flavored menthol-containing solid objects are advantageously comparable in size, although the disclosure is not limited thereto. The weight of the flavored menthol-containing solid objects can similarly vary. In some embodiments, the weight of a flavored menthol-containing solid object ranges from about 0.5 to about 3.0 grams, from about 0.75 to about 2.5 grams, or from about 1.0 to about 2.0 grams.

In some embodiments, the flavored menthol-containing solid object is a sphere with an average diameter of about 0.2 to about 5 mm, about 0.3 to about 4 mm, about 0.5 to about 3 mm, or about 1 to about 2 mm. In some embodiments, the flavored menthol-containing solid object comprises a spheroid with an average major radius ranging from about 0.1 to about 2.5 mm, about 0.2 to about 2.0 mm, about 0.5 to about 1.5 mm, or from about 0.75 to about 1.25 mm. In some embodiments, the flavored menthol-containing solid object is a flake with a thickness of about 0.1 to about 3 mm, about 0.25 to about 2.5 mm, about 0.5 to about 2.0 mm, about 0.75 to about 1.5 mm, or about 1.0 to about 1.25 mm. In some embodiments, flakes have an average length of about 1 to about 20 mm, about 5 to about 15 mm, or about 8 to about 12 mm. In some embodiments, flakes have an average width of about 1 to about 15 mm, about 2 to about 10 mm, or about 5 to about 8 mm. For additional examples on possible shapes and sizes, see U.S. Pat. No. 9,119,420 to Sebastian et al.; U.S. Pat. No. 9,078,460 to Becker et al.; U.S. Pat. No. 5,147,034 to Perfetti et al.; and U.S. Appl. Pub. Nos. 2014/0360518 to Besso et al.; and 2009/0235941 to Chida et al., which are incorporated by reference herein in their entireties.

Method of Making Flavored Menthol-Containing Solid Objects

The disclosed flavored menthol-containing solid objects can generally be prepared from melts using the methods described herein below. Generally, the flavored menthol-containing solid objects are prepared by melting and mixing the components and cooling the resulting mixture (e.g., on chilled surfaces or in molds) to render flavored menthol-containing solid objects.

A menthol melt is generally formed by exposing solid menthol to elevated temperature to produce a menthol melt (i.e., molten menthol). Menthol is a solid at room temperature (i.e., a temperature of about 25° C. to about 28° C. at atmospheric pressure (1 atm)) and has a melting point ranging from about 36° C. to about 45° C., depending on the chemical and enantiomeric purity of the menthol. For example, menthol with an excess of L-menthol generally has a higher melting point (e.g., about 42 to about 45° C.) than racemic menthol (e.g., about 36 to about 38° C.) at atmospheric pressure. As such, the menthol melt is generally prepared by heating the menthol at a temperature ranging from about 36° C. to about 45° C. (or at least 36° C., at least 38° C., at least 42° C., or at least 45° C., with an upper boundary of the boiling point of menthol, which is about 212° C.). It is understood that, although the melt is generally prepared at atmospheric pressure, it can alternatively be prepared at a pressure above or below atmospheric pressure (and relevant temperatures will scale accordingly).

As described herein above, the menthol can be natural or synthetic. For example, L-menthol can be isolated from the crude peppermint oils obtained from *Mentha arvensis* (content: 70 to 80% by weight) and/or *Mentha piperita* (content: 50 to 60% by weight), e.g., by crystallization. See, for example, U.S. Pat. No. 8,785,698 to Nagaoka et al., which is incorporated by reference herein in its entirety. Other purification methods may also be employed to provide menthol either as a racemic mixture of L- and D-menthol or as an enantiomerically purified form (preferably as the L-menthol isomer). See, for example, U.S. Pat. No. 2,662,052 to Grover et al.; U.S. Pat. No. 4,011,270 to Carrington et al.; U.S. Pat. No. 5,019,658 to Cahn et al.; and U.S. Pat. No. 7,459,587 to Nakayasu et al., which are incorporated by reference herein in their entireties. For the preparation of synthetic menthol, many methods are known. For example, synthetic routes using thymol as a starting material for the preparation of synthetic L-menthol have been disclosed. See, for example, U.S. Pat. No. 1,625,771 to Schollkopf et al.; and U.S. Pat. No. 4,058,571 to Biedermann et al; and U.S. Appl. Pub. No. 2014/0066665 to Mechelhoff et al., which are incorporated by reference herein in their entireties. Synthetic preparations using different starting materials have also been used. See, for example, U.S. Pat. No. 5,663,460 to Yamamoto et al.; U.S. Pat. No. 7,709,688 to Bergner et al.; U.S. Pat. No. 8,318,985 to Heydrich et al.; U.S. Pat. No. 6,342,644 to Sayo et al.; U.S. Pat. No. 9,061,959 to Bahta et al., which are incorporated by reference herein in their entireties. In some embodiments, the menthol is further purified, e.g., using distillation and/or recrystallization methods prior to preparing the noted menthol melt. The menthol crystals obtained from such purification methods can vary in size and are useful as long as a melt can be formed (considering that larger crystals may take a longer time to fully melt/mix with other components in the melt than smaller crystals).

The flavorant(s) can be added at various stages of the disclosed process. In some embodiments, the menthol is melted in the presence of the flavorant to afford a molten mixture. For example, in some embodiments, solid menthol and flavorant are combined prior to or during heating of the menthol to provide the molten mixture. As solid menthol is melting, the menthol and flavorant(s) combine to generate the molten mixture. In some embodiments, such combining is promoted by stirring and/or agitating.

In other embodiments, the menthol melt is first independently prepared and then the flavorant is added to the melt to form the molten mixture. In some embodiments, additional stirring and/or agitation ensures mixing of the flavorant with the menthol to form a homogeneous molten material. In some embodiments, more than one flavorant and/or optional additional ingredients, as referenced herein above, is added to the molten mixture. In such embodiments, flavorant and/or optional additional ingredients can be added to the melt at the same time or sequentially in any order. In some embodiments, the menthol can be only partially melted prior to the addition of any flavorants and/or optional additional ingredients.

A heat source is typically applied during the melting process to promote melting of the solid. The heat source can be applied during at least a portion of the time period required to form the melt or can be applied during the entire time period required to form the melt. Typically, although not limited thereto, the flavorant and optional additional ingredients have melting and/or boiling points lower than the temperature of the menthol melt. In some embodiments, no heat source is applied during the time period when flavorants and/or optional additional ingredients are being added to the menthol melt.

The resulting molten material comprising menthol and flavorant is next allowed to cool. The shape and size of the resulting flavored menthol-containing solid object can be controlled to achieve the desired shape/size referred to herein above. In some embodiments, the method of production of the solid objects dictates the shape, size, and or weight of the individual objects.

For example, in some embodiments, the flavored menthol-containing solid object is provided in the form of a flake by bringing the molten mixture comprising menthol and flavorant into contact with a surface (e.g., by pouring the molten mixture onto the surface). The molten mixture is allowed to cool and solidify. In some embodiments, the surface is horizontal and in some embodiments, the surface is not curved. In some embodiments, the surface is chilled, e.g., below room temperature to promote faster solidification of the molten material. The solidified flavored menthol-containing material can be removed from the surface (e.g., by scraping) in the form of flakes, e.g., using an implement such a knife (but not limited thereto). See, for example, U.S. Pat. No. 3,064,311 to Bain et al. and U.S. Pat. No. 8,288,593 to Rauls et al., which describe flaking of menthol and which are incorporated by reference herein in their entireties.

In other embodiments, the molten mixture comprising menthol and flavorant is brought into contact with a surface to form a three-dimensional shape. For example, in some embodiments, the molten mixture is dripped onto a surface to form shapes such as spheres, teardrops, and/or spheroids. In some embodiments, a cooling belt can be used as the surface. In some embodiments, spheres generated in this manner have an average diameter ranging from about 0.1 to about 6 mm. The transferred units (e.g., spheres, teardrops, and/or spheroids) are then removed from the surface when solidification is complete. In some embodiments, an optional cooling medium (e.g., cold air) may be used. See, for example, U.S. Pat. No. 8,785,698 to Nagaoka et al. and U.S. Pat. Appl. Pub. No. 2009/0235941 to Chida et al., which are hereby incorporated by reference herein in their entireties. In some embodiments, no surface is used, but rather, the molten mixture is transferred (e.g., dripped) into a liquid cooling medium, e.g., cooled water, to solidify into three-dimensional shapes. See, for example, the methods disclosed in U.S. Pat. Appl. Pub. No. 2009/0011238 to Rheinlander et al., which is incorporated by reference herein in its entirety.

In some embodiments, the molten mixture is introduced into a mold to provide molded flavored menthol-containing solid objects. The molten mixture is kept in the mold for a period of time to allow the temperature of the molten mixture to decrease, allowing the material to solidify. In some embodiments, the surface of the mold is chilled, e.g., the surface temperature of the mold is below room temperature, to promote faster solidification of the molten mixture. The time it takes for the molten mixture to solidify can vary and generally depends on the initial temperature of the molten mixture, and/or the size of the mold (e.g., larger molds can require longer times for solidification of the molten mixture than smaller molds) and the surface temperature of the mold (e.g., a chilled surface promotes faster solidification of the molten mixture). The resulting solid is then removed from the mold to afford individual flavored menthol-containing solid objects. Exemplary molding techniques are disclosed, e.g., in U.S. Pat. No. 5,626,896 to Moore et al. and U.S. Pat. Appl. Pub. No. 2015/0004291 to Alzemi et al., which are incorporated by reference herein in their entireties.

Method of Making a Flavored Menthol-Containing Material-Coated Component of a Smoking Article The flavored menthol-containing solid object produced according to the methods disclosed herein above can be used as an input material for hot melt application to a component of a smoking article. A typical hot melt application apparatus comprises: a melting station in which compositions can be heated to form a melt; and a dispensing device that releases the melt onto the component to be coated (e.g., by spraying the melt onto the component, brushing the melt onto the component, dipping the component into the melt, or otherwise applying the melt to the component). See, for example, the hot melt application methods and apparatus disclosed in U.S. Pat. No. 3,348,520 to Lockwood et al.; U.S. Pat. No. 5,012,829 Thesing et al.; U.S. Pat. No. 5,269,329 to Geer at al.; U.S. Pat. Appl. Pub. No. 2004/0224086 to Wright et al.; and European Pat. Pub. Appl. No. 0 223 454 to Walt et al., which are incorporated by reference herein in their entireties. The dispensing device can be any device that is able to dispense molten material, e.g., in a controlled manner with respect to but not limited to the volume and flow rate of molten material being released. Exemplary dispensing devices and coating processes are disclosed in U.S. Pat. No. 5,387,285 to Rivers et al. and U.S. Pat. No. 7,770,585 to Fowles et al., which are herein incorporated by reference in their entireties.

The flavored menthol-containing solid object discussed herein can advantageously be used as an input material for hot melt applications instead of adding menthol and flavorants individually to the melting station. The flavored menthol-containing solid object can be directly employed such that the resulting melt already contains the desired ingredients (including menthol and flavorant) in the desired relative amounts. Advantageously, this method does not require the addition of any additional ingredients (other than the menthol-containing object) to the melting station, although this disclosure is not intended to be limiting (i.e., additional ingredients can optionally be added to the melt). For example, further (e.g., non-volatile) flavorants can be added at this step although, as disclosed herein above, such components are preferably incorporated within the flavored menthol-containing solid object.

The disclosed method thus comprises adding the flavored menthol-containing solid object (e.g., in the form of a plurality of such objects) to the melting station, wherein the objects are heated. Where a plurality of such objects are added, they can be the same or different. For example, the ingredients (e.g., flavorants) of the solid objects can be different, and/or the relative amounts of menthol and flavorant of the solid objects can be different. The temperature applied during this heating step can vary, but generally is sufficient to melt the flavored menthol-containing solid objects, producing a molten mixture. In some embodiments, the temperature applied is lower than the boiling point of the flavorant. In some embodiments, the temperature applied is lower than the boiling point of menthol. In some embodiments, the flavored menthol-containing solid objects are stirred or agitated during the heating step.

The molten material is substantially free of carrier materials and diluents in preferred embodiments. The term "substantially free" means that any amount of carrier material present in the molten material is less than 5%, 4%, 3%, 2%, 1% by weight based on the total weight of the molten material. In certain preferred embodiments, the molten material is in "neat," form, meaning that it consists essentially of the components of the flavored menthol-containing solid object (i.e., no additional ingredients are added to the melting station or otherwise combined with the flavored menthol-containing solid object).

The resulting molten mixture, comprising menthol and flavorant, is then applied to a smoking article component using traditional techniques. Smoking article components to be coated using the disclosed method include any component which is exposed to an increase in temperature during use of the smoking article. For example, in the smoking article depicted in FIG. 1, the molten material containing menthol and flavorant can be applied to any one or more of the following components: the filter plug (26), the cylindrical tobacco rod (12), the wrapping material (16), the plug wrap (28), or any combination thereof. In some embodiment the filter plug is advantageously coated with the molten material to give a coated filter plug and, in some embodiments, the tobacco rod is advantageously coated with the molten material to give a coated filter rod.

The amount of molten material applied to the smoking article component can vary. In some embodiments, the predetermined amount is based on the number of coats applied to the component of the smoking article. The number of coats of molten material applied onto the component of the smoking article depends on the strength of the flavor/aroma profile to be delivered to the consumer during use of the resulting smoking article. For example, a stronger flavor/aroma profile of a flavored mainstream smoke can be achieved with a component having multiple coats of molten material disposed thereon, rather than a single coat. However, advantageously, the strength of the flavor/aroma profile obtained using the disclosed method (e.g., by applying a single coat to a single component) is increased relative to traditional techniques that apply a single coat of a carrier and/or diluent-containing composition as, advantageously, the flavor/aroma-generating components (e.g., menthol and flavorant) are provided neat and thus in greater overall concentrations to the smoking article component.

In some embodiments, the amount of molten material applied is based on the surface area of the smoking article component to be coated. In general, components of a smoking article having a larger surface require more molten material to be applied (for full coverage of the surface area thereof) than smoking article components having less surface area. For example, the amount required to effectively coat a filter plug is typically less than the amount required to effectively coat a tobacco rod because the surface area of the filter plug is less than the surface area of the tobacco rod.

The molten material can be applied using different application methods and, in some embodiments, the specific method of application is dependent upon the dispensing device associated with the hot melt apparatus employed. For example in some embodiments, the molten material is sprayed or brushed onto the smoking article component (or a portion thereof). In some embodiments, the smoking article component (or a portion thereof) is dipped into the molten material. In some embodiments, the molten material is applied through one or more nozzles in the dispensing device. Preferred methods of application of the molten material provide a coating of substantially uniform thickness on the coated smoking article component. As referenced above, the percent surface area of the smoking article component that is coated according to the disclosed method can vary. In some embodiments, the amount of surface of the component of the smoking article coated with the molten material is at least 50%, at least 60%, at least 70%, at least 80%, at least 90%, at least 95%, at least 96%, at least 97%, at least 98%, at least 99%, or 100% based on the total surface area of the component (with an upper boundary of 100%).

The applied molten material is allowed to cool, resulting in a solidified coating of flavored menthol-containing material on the coated smoking article component. In some embodiments, the applied molten material is allowed to cool/solidify at room temperature. In some embodiments, it is subjected to a temperature cooler than room temperature, which can increase the rate of solidification. The application step with respect to a smoking article component can be done once or can be repeated to apply additional coats of the molten material thereto. Typically, where more than one coat is applied, a coat is applied and cooled to solidify the first coat, and then a second coat is applied thereto. This process can be repeated to achieve any desired number of coats of flavored menthol-containing material to the smoking article component. The flavored menthol-containing material coating (or coatings) can be applied so as to achieve various coating weights of up to about 50% by weight based on the smoking article in its entirety.

Smoking Articles with a Flavored Menthol-Containing Material-Coated Component

The disclosed coated smoking article components can be incorporated within any smoking article. Examples of such smoking articles include but are not limited to tobacco-based smoking articles (e.g., conventional tobacco cigarettes), tobacco-free smoking articles (e.g., herbal cigarettes), or vapor-based smoking articles (e.g., electronic cigarettes). Advantageously, the coated smoking article component is incorporated within a smoking article such that it is subjected to heat during use, allowing for vaporization of at least a portion of the menthol and/or flavorant in the coating, allowing the resulting vapor to combine with the mainstream smoke generated by the smoking article before reaching the consumer. As such, such smoking articles can exhibit an altered flavor/aroma profile with respect to smoking articles that do not contain such components, e.g., a minty, refreshing cooling sensation from the menthol and any one of a number of flavors, depending upon the specific flavorant within the coating.

For example, in some embodiments, the smoking article is a tobacco-based smoking article, wherein various types of cigarette components, including tobacco types, tobacco blends, top dressing and casing materials, blend packing densities; types of paper wrapping materials for tobacco rods, types of tipping materials, and levels of air dilution, can be employed. See, for example, the various representative types of cigarette components, as well as the various cigarette designs, formats, configurations and characteristics, that are set forth in U.S. Pat. No. 5,220,930 to Gentry; U.S. Pat. No. 6,779,530 to Kraker; U.S. Pat. No. 7,565,815 to Oglesby; U.S. Patent Application Publication Nos. 2005/0016556 to Ashcraft et al.; 2005/0066986 to Nestor et al.; 2007/0246055 to Thomas et al.; and 2015/0374029 to Stokes et al; each of which is incorporated herein by reference.

In some embodiments, the tobacco-based smoking article has a rod-shape, comprising a lighting end and a mouth end as illustrated in FIG. 1. The tobacco-based smoking article 10 is in the form of a cigarette possessing certain representative components. The cigarette 10 in FIG. 1 includes a generally cylindrical rod 12 of a charge or roll of smokable filler material contained in a circumscribing wrapping material 16. The rod 12 is conventionally referred to as a "tobacco rod". Tobacco rods are typically manufactured using a cigarette making machine, such as a conventional automated cigarette tobacco rod making machine. Exemplary cigarette tobacco rod making machines are of the type commercially available from Molins PLC or Hauni-Werke Korber & Co. KG. For example, cigarette tobacco rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 6,848,449 to Kitao et al.; and U.S. Pat. No. 6,904,917 to Kitao et al.; and U.S. Patent Application Publication Nos. 2003/0145866 to Hartman; 2004/0129281 to Hancock et al.; 2005/0039764 to Barnes et al.; and 2005/0076929 to Fitzgerald et al.; each of which is incorporated herein by reference. The ends of the tobacco rod 12 are open to expose the smokable filler material. The cigarette 10 is shown as having one optional band 22 (e.g., a printed coating including a film-forming agent, such as starch, ethylcellulose, or sodium alginate) applied to the wrapping material 16, and that band circumscribes the cigarette tobacco rod in a direction transverse to the longitudinal axis of the cigarette. That is, the band 22 provides a cross-directional region relative to the longitudinal axis of the cigarette. The band 22 can be printed on the inner surface of the wrapping material (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

At one end of the tobacco rod 12 is the lighting end 18, and at the mouth end 20 is positioned a filter rod 26. The filter rod 26 is positioned adjacent one end of the tobacco rod 12 such that the filter rod and tobacco rod are axially aligned in an end-to-end relationship, preferably abutting one another. Filter rod 26 may have a generally cylindrical shape, and the diameter thereof may be essentially equal to the diameter of the tobacco rod. The ends of the filter rod 26 permit the passage of air and smoke therethrough. A ventilated or air diluted smoking article can be provided with an optional air dilution means, such as a series of perforations 30, each of which extend through the tipping material 40 and plug wrap 28. The optional perforations 30 can be made by various techniques known to those of ordinary skill in the art, such as laser perforation techniques. Alternatively, so-called off-line air dilution techniques can be used (e.g., through the use of porous paper plug wrap and pre-perforated tipping material). For cigarettes that are air diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. Typically, the upper level for air dilution for an air diluted cigarette is less than about 80 percent, and often is less than about 70 percent. As used herein, the term "air dilution" is the ratio (expressed as a percentage) of the volume of air drawn through the air dilution means to the total volume and air and smoke drawn through the cigarette and exiting the extreme mouth end portion of the cigarette. The tow-based filter rod 26 can be attached to the tobacco rod 12 using the tipping material 40 (e.g., essentially air impermeable tipping material), that circumscribes both the entire length of the filter element and an adjacent region of the tobacco rod 12. The inner surface of the tipping material 40 is fixedly secured to the outer surface of the plug wrap 28 and the outer surface of the wrapping material 16 of the tobacco rod, using a suitable adhesive; and hence, the filter element and the tobacco rod are connected to one another to form the smoking article 10.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,360,751 to Fagg et al.; and U.S. Patent Application Publication No. 2003/0136419 to Muller; each of which is incorporated herein by reference. The automated cigarette making machines of the type set forth herein provide a formed continuous cigarette tobacco rod or smokable rod that can be subdivided into formed smokable rods of desired lengths.

Filter rods can be manufactured, e.g., using a rod-making apparatus, and an exemplary rod-making apparatus includes a rod-forming unit. Representative rod-forming units are available as KDF-2 and KDF-3E from Hauni-Werke Korber & Co. KG; and as Polaris-ITM Filter Maker from International Tobacco Machinery. Filter material, such as cellulose acetate filamentary tow, typically is processed using a conventional filter tow processing unit. For example, filter tow can be bloomed using bussel jet methodologies or threaded roll methodologies. An exemplary tow processing unit has been commercially available as E-60 supplied by Arjay Equipment Corp., Winston-Salem, N.C. Other exemplary tow processing units have been commercially available as AF-2, AF-3 and AF-4 from Hauni-Werke Korber & Co. KG. and as Candor-ITM Tow Processor from International Tobacco Machinery. Other types of commercially available tow processing equipment, as are known to those of ordinary skill in the art, can be employed. Other types of filter materials, such as gathered paper, nonwoven polypropylene web or gathered strands of shredded web, can be provided using the types of materials, equipment and techniques set forth in U.S. Pat. No. 4,807,809 to Pryor et al. and U.S. Pat. No. 5,025,814 to Raker. In addition, representative manners and methods for operating a filter material supply units and filter-making units are set forth in U.S. Pat. No. 4,281,671 to Bynre; U.S. Pat. No. 4,850,301 to Green, Jr. et al.; U.S. Pat. No. 4,862,905 to Green, Jr. et al.; U.S. Pat. No. 5,060,664 to Siems et al.; U.S. Pat. No. 5,387,285 to Rivers and U.S. Pat. No. 7,074,170 to Lanier, Jr. et al.

Filtered cigarettes incorporating filter elements provided from filter rods that are coated in accordance with the present invention can be manufactured using traditional types of cigarette making techniques. For example, so-called "six-up" filter rods, "four-up" filter rods and "two-up" filter rods that are of the general format and configuration conventionally used for the manufacture of filtered cigarettes can be handled using conventional-type or suitably modified cigarette tobacco rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; and U.S. Pat. No. 6,229,115 to Vos et al.; and U.S. Patent Application Publication Nos. 2005/0103355 to Holmes and 2005/1094014 to Read, Jr.; each of which is incorporated herein by reference. The operation of those types of devices will be readily apparent to those skilled in the art of automated cigarette manufacture. In some embodiments, cigarette filter rods that are coated in accordance with the present invention can be used to provide multi-segment filter rods (wherein one or more such rods are coated). Such multi-segment filter rods can be employed for the production of filtered cigarettes possessing multi-segment filter elements. An example of a two-segment filter element is a filter element possessing a first cylindrical segment incorporating activated charcoal particles (e.g., a "dalmation" type of filter segment) at one end, and a second cylindrical segment that is produced from a filter rod produced in accordance with embodiments of the present invention. The production of multi-segment filter rods can be carried out using the types of rod-forming units that have been employed to provide multi-segment cigarette filter components. Multi-segment cigarette filter rods can be manufactured using a cigarette filter rod making device available under the brand name Mulfi from Hauni-Werke Korber & Co. KG of Hamburg, Germany.

In some embodiments, smoking articles are provided which include a single flavored menthol-containing material-coated component. In some embodiments, smoking articles include more than one flavored menthol-containing material-coated component. For example, in the smoking article depicted in FIG. 1, the flavored menthol-containing material-coated component can be the filter plug (26), the cylindrical tobacco rod (12), the wrapping material (16), the plug wrap (28), or any two or more such components. In one embodiment, a smoking article comprising a flavored menthol-containing material-coated filter plug is provided.

In another embodiment, a smoking article comprising a flavored menthol-containing material-coated tobacco rod is provided which can be prepared according to the methods outlined herein. In a further embodiment, a smoking article comprising a flavored menthol-containing material-coated filter plug and a flavored menthol-containing material-coated tobacco rod is provided.

In some embodiments, the flavor/aroma profile of the smoking article during use can be controlled by the amount (e.g., number of coats, surface area coverage, etc.) of flavored molten menthol applied to the component in the method disclosed herein above. A component with a thicker flavored menthol covering (e.g., prepared by applying more than one coating during the application process) can, in some embodiments provide a smoking article with stronger flavor/aroma than a component with a thin flavored menthol covering. Similarly, a larger component that is coated according to the foregoing methods incorporated into a smoking article can provide stronger flavor/aroma (e.g., by virtue of its surface area) than a smaller component that is coated according to these methods incorporated into the smoking article. The flavor/aroma profile of the smoking article during use can also be affected by the location of the coated component(s) within the smoking article. For example, referring back to the exemplary smoking article depicted in FIG. 1, a coated component located closer to the exit (20), e.g., the filter plug (26), would be expected to allow for vaporization of the coating components in closer proximity to the user, thereby producing a higher local concentration of the menthol and/or flavorant. In such embodiments, the contribution of the menthol and/or flavorant to the mainstream smoke would be expected to be enhanced as compared with the contribution to mainstream smoke where the coated component is located further from end 20, e.g., the tobacco rod (12).

In some embodiments, at least two different flavored menthol-coated components are present in a smoking article, wherein the flavored menthol-coated components comprise different flavorants, different flavorant concentrations, and/or different additional ingredients and as such, produce different individual flavor/aroma profiles, which combine with each other and the mainstream smoke.

EXPERIMENTAL

Aspects of the present invention are more fully illustrated by the following example, which is set forth to illustrate certain aspects of the present invention and is not to be construed as limiting thereof.

Example 1: Preparation and Evaluation of Flavored Menthol-Containing Solid Objects Sample 1 and Sample 2:

Natural menthol crystals (95 g) were added to a flask, which was placed into a water bath (100° C.). The menthol crystals melted to form a molten material to which spearmint oil (5 g) was added. The resulting mixture was manually stirred with a glass rod. The mixture was poured into molds and allowed to cool at room temperature (Sample 1) or at refrigeration temperature (about 0-4° C.) (Sample 2). The mixture solidified within the molds to form spearmint flavored menthol-containing solid objects, which were then removed from their individual molds to give Samples 1 and 2.

Sample 3:

Menthol crystals and spearmint oil were combined as described for Samples 1 and 2. The mixture was poured as a single layer onto a pre-chilled coldstone, which was then allowed to cool at refrigeration temperature (about 0-4° C.) to form a solidified layer. The layer was removed by scraping material off the coldstone to give flavored menthol-containing solid objects in the form of flakes.

Evaluation:

Samples 1-3, as well as a sample of untreated/as-received menthol crystals (Control Sample A) and a sample of neat spearmint oil (Control Sample B) were analyzed. The content of both menthol and spearmint oil was determined for each sample by Gas Chromatography (GC). See Table 1, below. Based on the amounts of the components in the preparation of the flavored menthol-containing solid objects of Samples 1-3, it was expected that each sample would have roughly 95 weight % menthol content and 5 weight % spearmint content. Although not intending to be limited by theory, it is believed that the noted difference in menthol content of Samples 1-3 may be due to the different temperatures used during solidification. Chilling the samples during solidification appears to be advantageous, likely due to less vaporization of menthol during fast cooling (resulting in higher menthol content for Samples 2 and 3 than for Sample 1).

With regard to the spearmint content, neat spearmint oil comprises several compounds, L-carvone being the most prevalent compound. The neat oil itself (Control B) was determined to have 70.7% L-carvone. The spearmint oil content was then calculated for each of Samples 1-3 by measuring the amount of L-carvone present in each and using the 70.7% L-carvone value of pure spearmint oil to determine the amount of spearmint oil in each experimental sample. As shown in Table 1, no significant difference in the content of spearmint oil is seen between inventive Samples 1-3.

TABLE 1

Preparation and evaluation of flavored menthol-containing solid objects

| Sample | Description | Menthol Content (weight %) | Spearmint Oil Content (weight %) |
|---|---|---|---|
| 1 | Molded, Ambient | 93.2 | 4.9 |
| 2 | Molded, Chilled | 95.1 | 4.8 |
| 3 | Scraped, Chilled | 95.2 | 4.6 |
| Control A (menthol only) | Untreated (as-received) menthol crystals (natural) | 99.3 | — |
| Control B (spearmint oil only) | Neat oil | | 70.7* |

*This value is based on L-carvone content, which is the most prevalent compound in spearmint oil.

As generally demonstrated, the menthol content and flavor oil content were largely maintained during production of the flavored menthol-containing solid objects prepared according to the referenced methods. This data generally demonstrates that the desired ratio of menthol to flavor oil can be obtained in the production of a flavored menthol-containing solid object.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

That which is claimed:

1. A method of making a flavored menthol-containing solid object for use as an input material for hot melt application to a smoking article component, comprising:

combining and heating menthol and a flavorant to give a molten mixture;

depositing the molten mixture onto a surface;

allowing the deposited molten mixture to cool to give a solidified mixture;

removing the solidified mixture from the surface to afford a flavored menthol-containing solid object;

melting the flavored menthol-containing solid object to afford a molten coating material;

applying the molten coating material to a smoking article component;

and allowing the applied molten coating material to solidify, to afford a flavored menthol-coated smoking article component.

2. The method of claim 1, further comprising chilling the surface.

3. The method of claim 1, wherein the menthol comprises L-menthol.

4. The method of claim 1, further comprising purifying the menthol prior to the combining and heating step.

5. The method of claim 4, wherein the purifying comprises recrystallizing.

6. The method of claim 1, wherein the flavorant is a flavor oil selected from one or more of mint, fruit, clove, and vanilla oils.

7. The method of claim 1, wherein the removing step comprises affording the flavored menthol-containing solid object in the form of a flake.

8. The method of claim 1, wherein the surface comprises molded three-dimensional shapes.

9. The method of claim 8, wherein the three-dimensional shapes are selected from a cube, cuboid, sphere, spheroid, cylinder, cone, prism, pyramid, frustum, and combinations thereof.

10. The method of claim 9, wherein the three-dimensional shapes are spheres.

11. The method of claim 1, wherein the flavored menthol-containing solid object has an average diameter of about 0.1 to about 6 mm.

12. The method of claim 1, wherein the flavored menthol-containing solid object comprises at least about 90% menthol by weight.

13. The method of claim 12, wherein the flavored menthol-containing solid object comprises at least about 95% menthol by weight.

14. The method of claim 1, wherein the flavored menthol-containing solid object comprises no more than 5% flavorant by weight.

15. The method of claim 1, wherein the weight of the flavored menthol-containing solid object is about 0.75 g to about 2.5 g.

16. The method of claim 1, further comprising repeating the applying and allowing steps to provide a flavored menthol-coated smoking article component with more than one coating thereon.

17. The method of claim 1, further comprising agitating or stirring during the melting step.

18. The method of claim 1, wherein the molten coating material is substantially free of diluents and carrier materials.

19. The method of claim 1, wherein the melting step comprises melting a plurality of flavored menthol-containing solid objects.

20. The method of claim 1, wherein the smoking article component is selected from a cylindrical tobacco rod, a filter rod, a filter material, wrapping material, and plug wrap material.

21. The method of claim 1, wherein the applying step comprises spraying the molten coating material onto the smoking article component.

22. The method of claim 1, further comprising incorporating the flavored menthol-coated smoking article component into a smoking article.

* * * * *